US009755386B2

(12) United States Patent
Moser et al.

(10) Patent No.: US 9,755,386 B2
(45) Date of Patent: Sep. 5, 2017

(54) DEVICE FOR CONTACTING ELECTRICAL CONDUCTORS AND/OR ELECTRICAL CONTACT ELEMENTS, AS WELL AS LAMP OR ELECTRICAL DEVICE

(71) Applicant: Tridonic GmbH & Co KG, Dornbirn (AT)

(72) Inventors: Peter Moser, Stans (AT); Thomas Riedler, Baumkirchen (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 15/103,246

(22) PCT Filed: Dec. 19, 2014

(86) PCT No.: PCT/AT2014/050309

§ 371 (c)(1),
(2) Date: Jun. 9, 2016

(87) PCT Pub. No.: WO2015/089540

PCT Pub. Date: Jun. 25, 2015

(65) Prior Publication Data

US 2016/0308320 A1 Oct. 20, 2016

(30) Foreign Application Priority Data

Dec. 19, 2013 (AT) ..... GM454/2013

(51) Int. Cl.
*H01R 4/66* (2006.01)
*H01R 31/02* (2006.01)
(Continued)

(52) U.S. Cl.
CPC ..... *H01R 31/02* (2013.01); *H01R 4/64* (2013.01); *H01R 9/2483* (2013.01); *H01R 13/745* (2013.01); *H01R 2107/00* (2013.01)

(58) Field of Classification Search
CPC ..... H01R 31/02; H01R 4/64; H01R 9/2483; H01R 13/745; H01R 2107/00
(Continued)

(56) References Cited

U.S. PATENT DOCUMENTS 3,007,131 A 10/1961 Dahlgren et al.
3,629,809 A * 12/1971 Tillmann ..... H01R 23/70 439/629

(Continued)

FOREIGN PATENT DOCUMENTS

AT 13096 U1 6/2013
DE 29823911 U1 1/2000

(Continued)

OTHER PUBLICATIONS

International Search Report and Written Opinion issued in connection with the corresponding International Application No. PCT/AT2014/050309 dated Apr. 15, 2015.

(Continued)

*Primary Examiner* — Khiem Nguyen
(74) *Attorney, Agent, or Firm* — The H.T. Than Law Group

(57) ABSTRACT

The invention relates to a device 1 for contacting electrical conductors and/or electrical plug connectors, said device comprising at least one front housing part 2 and a rear housing part 3, wherein the front housing part 2 and the rear housing part 3 are formed as one unit, wherein at least one first electrical contact connection is provided in the front housing part via contacting points 7, and at least one additional electrical contact connection is provided in the rear housing part 3 via contacting points 9, wherein a step 6 is formed between the front housing part 2 and the rear housing part 3 on one side of the device 1, and wherein contacting points 8 are provided in the region of the step 6 for the purposes of electrical contacting. The invention also relates to a lamp or an electrical device having a device of this type.

10 Claims, 4 Drawing Sheets

(51) Int. Cl.

| | |
|---|---|
| ***H01R 4/64*** | (2006.01) |
| ***H01R 9/24*** | (2006.01) |
| ***H01R 13/74*** | (2006.01) |
| *H01R 107/00* | (2006.01) |

(58) Field of Classification Search
USPC ..... 439/92, 95, 101, 108
See application file for complete search history.

(56) References Cited

U.S. PATENT DOCUMENTS 4,129,353 A * 12/1978 Tabuchi ..... H01R 9/2408 439/719
5,322,447 A 6/1994 Okada
5,584,709 A 12/1996 Kiat
2012/0142671 A1 6/2012 Jia et al.

FOREIGN PATENT DOCUMENTS

DE 10216574 A1 10/2002
DE 20306768 U1 9/2004

OTHER PUBLICATIONS

Translation of DE 10216574 A1 to Gerberding Wolfgang.
Translation of AT13096 to Tridonic Connection Technology GmbH & Co KG.
Austrian Search Report issued in connection with the corresponding Austrian patent application No. GM 454/2013 dated Oct. 10, 2014.
English translation of DE 20306768 to Weidmueller.
English translation of DE 29823911 to Dorn Uwe.

* cited by examiner

DEVICE FOR CONTACTING ELECTRICAL CONDUCTORS AND/OR ELECTRICAL CONTACT ELEMENTS, AS WELL AS LAMP OR ELECTRICAL DEVICE

FIELD OF THE INVENTION

The invention relates to a device for the contacting of electrical conductors and/or electrical contact elements according to the preamble of claim 1, and a lamp or an electrical device.

Such devices, also known as terminal and connecting clamps, are used, for example, for the electrical connection of lamps. They can also be used in the case of LED applications or also for other electrical devices.

BACKGROUND OF THE INVENTION

With existing systems for lamps, primarily in the case of rail-mounted lamps with individual lamps which are arranged on a rail, devices are provided, which, on the one hand, comprise a connecting clamp for the power and/or control lines and, on the other hand, a tapping in order to guarantee the further electrical connection to the illuminant. The connecting clamp and the tapping can be per se known products which are independent of one another. The raster for the connecting clamp and the raster for the tapping can therefore be different in part. For example, the connecting clamp and the tapping can be connected to individual conductors, wherein the conductors should, inter alia, be terminated and insulated. As a result, the assembly effort is considerable, many individual components are required, and the entire device requires a large space within the lamp, primarily in length.

For example, AT 13096 U1 is known from the prior art, wherein the device comprises a front housing park and a rear housing part as one unit, electrical connecting elements, which are arranged in each case between the contacting points in the front housing part and the contacting points in the rear housing part within the unit and connect the latter, wherein the respective electrical connecting elements can compensate an existing offset between the connected contacting points in the front housing part and rear housing part. It is disadvantageous that the plugging possibilities in the device are restricted, there is only one group of contacting points in the front housing part and a further group of contacting points in the rear housing part.

SUMMARY OF THE INVENTION

The invention is based on the object of developing further a device of the types specified in the introduction in such a manner that the contact connection of electrical conductors and/or electrical contact elements can be embodied even more flexibly, and the assembly of the device in the lamp or in the electrical device is further simplified.

The solution to these objects is achieved according to the invention by the features specified in the independent claims.

The device according to the invention for contacting electrical conductors and/or electrical plug connectors comprises at least a front housing part and a rear housing part, wherein the front housing part and the rear housing part are embodied as one unit, wherein at least one first electrical contact connection via contacting points in the front housing part and at least one additional electrical contact connection via contacting points in the rear housing part are provided.

One substantial feature of the device according to the invention is that a step is embodied on one side of the device between the front housing part and the rear housing part, wherein contacting points are provided for the electrical contact connection in the region of the step.

Accordingly, an outer edge or respectively a plane of the front housing part is arranged offset by comparison with the outer edge or respectively the plane of the rear housing part on the same side of the device.

By preference, the contacting points are arranged in the front housing part. Accordingly, the rear housing part is embodied narrower at least in one direction than the front housing part.

It is advantageous if the step between the front housing part and the rear housing part is embodied in the lower side of the device.

According to one preferred embodiment of the device, a clearance can be provided on the lower side of the rear housing part. Accordingly, the contacting points for the electrical contact connection in the region of the step are readily accessible. It simplifies the assembly and the wiring or respectively cable configuration in the lamp or in the electrical device, because a further looping to further electrical or electronic devices below the device, such as baluns or converters, becomes possible.

The front housing part and the rear housing par can be connected directly to one another. Alternatively, at least a part of the front housing part and a part of the rear housing part can be embodied in one piece. Devices wherein the front housing part and the rear housing part are separated from one another and are connected exclusively by means of flexible electrical connecting elements are not the subject matter of the invention.

For this purpose, it is preferred that the electrical contact connection comprising the contacting points in the region of the step is provided directly with the first electrical contact connection of the contacting points in the front housing part.

Furthermore, the electrical contact connection comprising the contacting points in the region of the step can take place directly in the per se known punched part, which is provided for the first electrical contact connection of the contacting points in the front housing part.

It brings the advantage that no other additional electrical connection between the first contacting points and the contacting points according to the invention is necessary. The manufacture of the device according to the invention is simplified as a result. Collisions of a further, additional electrical connection with the contacting points of the rear housing part are therefore also avoided, because the contacting points according to the invention are not arranged on the rear end-face of the rear housing part.

It is advantageous that the electrical contact connection to further electrical or electronic devices at the contacting points in the region of the step is provided for rigid or flexible electrical conductors, male pin plugs or plug connectors. Per se known contacting points can be used in the region of the step.

For this purpose, the total height of the device according to the invention is not impaired. The height of the front housing part remains preserved, and the height of the rear housing part is even smaller than the height of the front housing part. The improved device can, for example, continue to be used in a per se known lamp rail, because its total height is unchanged by comparison with the previous devices.

With the device according to the invention, several such devices can now be assembled in series or respectively one after the other, for example, in a rail system for lamps, wherein the level or respectively the assembly plane for all devices is the same.

A further substantial feature of the invention is that at least one electrical contact connection is provided in the rear housing part via contacting points for the electrical contact connection with further electrical or electronic devices, and that at least one electrical contact connection via contacting points for the electrical supply, especially mains supply, is provided in the rear housing part.

For this purpose, the electrical contact connections via contacting points on the rear housing part can be embodied as plug connections.

This brings the advantage that an additional supply is present. Punched parts can preferably be used for the electrical contact connection of the plug connector with the device. For a mains supply, different requirements for an electrical contact connection must be taken into consideration, the same but contrary punched parts can be used in the plug connector and in the contacting point for a contact connection. This allows a connection for higher current passages and larger cross sections.

Furthermore, two groups of contacting points can be provided in the rear housing part, in each case as tapping or respectively plug. The tapping or respectively plug, which can optionally be a per se known plug, can serve, for example, for the further looping to other light-bars.

Additionally, an earth contact can be present on the device, and at least one contacting point can be provided for the earth contact.

It is preferable that the earth contact is embodied as a strip on the device and/or that the earth contact can be active with a further component in the assembled or respectively prestressed condition.

This possible embodiment as earth strip is particularly advantageous for a device which is used in a rail system, because the earth strip can be clamped in the tunnel of the rail system.

The device according to the invention can be used, for example, as a lamp connecting clamp, especially for individual lamps, which can also be disposed in a rail system. As a result of its small or respectively low structural shape in height and width, it can also be used in LED applications.

The device according to the invention can preferably be a screw-less terminal or connecting clamp.

Furthermore, the invention also relates to a lamp with the device according to the invention. The invention can also relate to an electrical device with the device according to the invention.

In the following, the invention is described in greater detail with reference to an embodiment, which should, however, be understood only as exemplary but not restrictive.

DETAILED DESCRIPTION OF THE PREFERRED EMBODIMENTS

Figure 1:
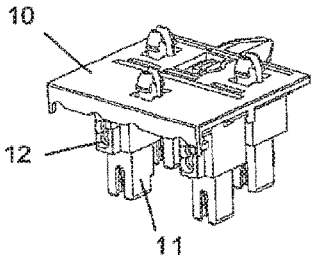
FIG. 1: perspective view of a first embodiment of the device according to the invention with an earth strip and a tapping.
Figure 2:
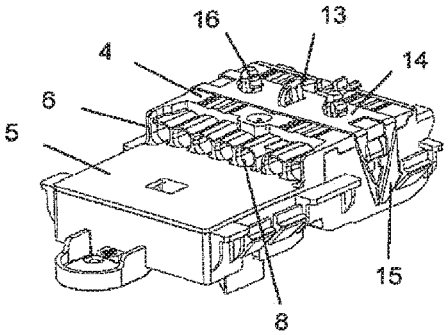
FIG. 2: further perspective view of the device according to the invention as shown in FIG. 1.

FIG. 1 and FIG. 2 illustrate a device 1 according to the invention for the contacting of electrical conductors which are not illustrated, and an electrical plug connector, illustrated as plug 10. This device 1 is embodied here as a terminal and connecting clamp.

The device 1 comprises a front housing part 2 and a rear housing part 3. In the front housing part 2, electrical connections can be made, and, in the rear housing part 3, further electrical connections can be made. In the front housing part 2, the contacting points 7 can be embodied as per se known connection terminals. In the rear housing part 3, the contacting points 9 can be embodied as per se known female plug connections for the contacts 11 of the plug 10. Furthermore, the plug 10 can comprise connection terminals 12 in order to allow an electrical connection with further electrical elements which are not illustrated.

The lower side 5 of the rear housing part 3 of the device 1 is arranged offset relative to the lower side 4 of the front housing part 2 of the device 1, so that a step exists between lower side 4 of the front housing part 2 and lower side 5 of the rear housing part 3. The upper side of the front housing part 2 and the upper side of the rear housing part 3 are preferably provided on the same plane, as illustrated. The shoulder between the lower side 4 of the front housing part 2 and the lower side 5 of the rear housing part 3 allows the arrangement of contacting points 8 on the lower side of the device 1, which are illustrated by way of example in this embodiment as terminal connections.

Furthermore, fastening elements 16 can be provided on the lower side of the device 1, here, as snap-fastening element, in order to a fastening of the device 1 with elements which are not illustrated. In particular, the device 1 can be fitted to lighting modules or lighting elements.

The device 1 also comprises a per se known earth 13 on the lower side 4 of the front housing part 2. According to the invention, an earth strip 14 is provided on the lower side 4 of the front housing park 2, which is disposed in constant contact with the earth 13 and comprises spring arms 15 at the side of the front housing part 2. In particular, in the case of the contacting points 7, a terminal connection is provided for the earth.

It is also conceivable that the earth 13 is dispensed with and that only the earth strip 14 is present on the device 1. In this case, an electrical connection or respectively contact connection is present between a terminal connection of the contacting point 7 and the earth strip 14.

Figure 3:
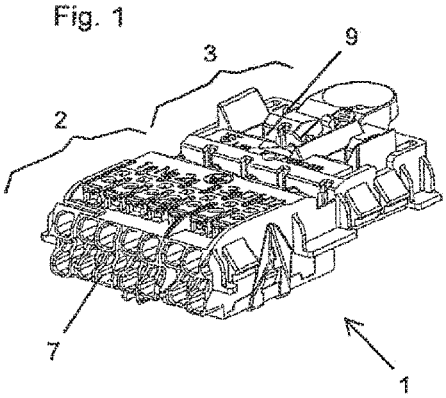
FIG. 3: front view of a device according to the invention in a rail system.
Figure 3:
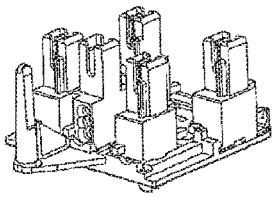
Figure 3:
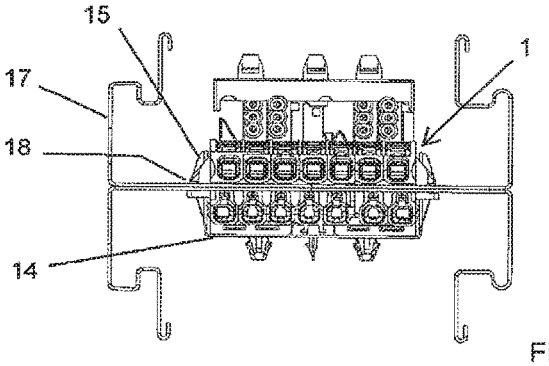

FIG. 3 illustrates one possible area of application for the device 1. The device 1 is arranged in a rail system 17, preferably a rail system for lighting elements, which are not illustrated, wherein the device 1 can be fitted in a sheet aperture 18 of the rail system 17.

The earth strip 14 is clamped in the sheet aperture 18 by means of its spring arms 15, and an earth contact to the rail system is therefore provided.

Figure 4:
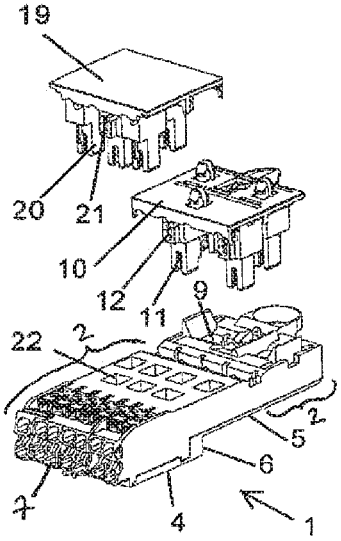
FIG. 4: perspective view of a second embodiment of the device according to the invention with two tappings.
Figure 5:
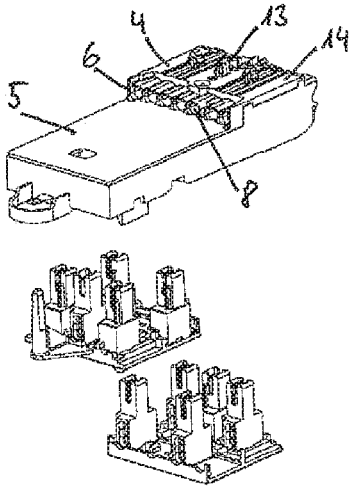
FIG. 5: further perspective view of the device according to the invention as shown in FIG. 4.

FIG. 4 and FIG. 5 illustrate a further embodiment of the device according to the invention, wherein an additional connection possibility is provided, here, by comparison with FIG. 1, in the rear housing part 3. The contacting point 22 is provided on the upper side of the device 1. In this embodiment, a plug 19 matches the contacting point 22, wherein the plug 19 is largely similar to the plug 10. During assembly, the contacts 20 of the plug 19 are plugged into the contacting points 22. The terminal connections 21 of the plug 19 are provided for electrical conductors, not illustrated, which are per se known or respectively conventional for such applications, for further electrical connection.

Figure 6:
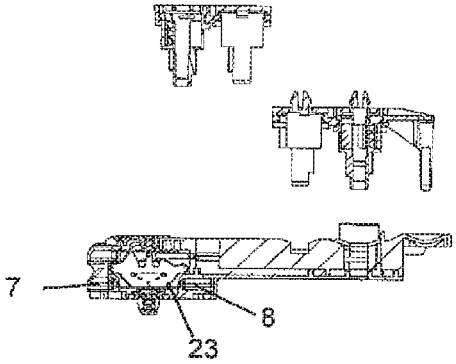
FIG. 6: lateral sectional view of the device according to the invention as shown in FIG. 4.

FIG. 6 shows a cross-sectional view of the device, wherein it is evident that the punched part 23, which ensures the electrical contact connection of the contacting point 7 within the device 1, also ensures the electrical contact connection of the contacting point 8 within the device 1. No additional punched parts or electrical connecting element is necessary for the contacting point 8.

Figure 7:
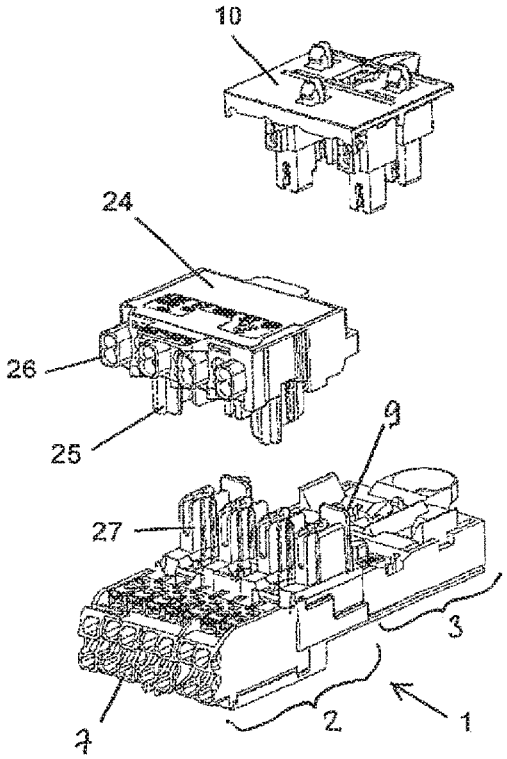
FIG. 7: perspective view of a further embodiment of the device according to the invention with tapping to the mains supply.
Figure 8:
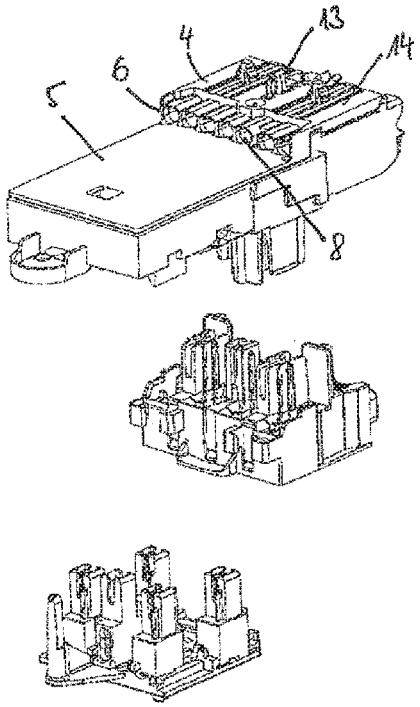
FIG. 8: further perspective view of a device according to the invention as shown in FIG. 7.

FIG. 7 and FIG. 8 show a third embodiment of the device according to the invention. In the front housing part 3, the additional connection possibility to the contacting point 9 is embodied as contacting point 27. In this embodiment, a plug 24 for the contacting point 27 matches the electrical connection, wherein the plug 24 is provided, for example, for a mains supply. The contacts 25 of the plug 24 are plugged into the contacting points 27 during assembly. The connecting point 26 of the plug 24 are preferably provided for a further plug, not illustrated, which is per se known or respectively conventional for such applications, for further electrical connection.

Figure 9:
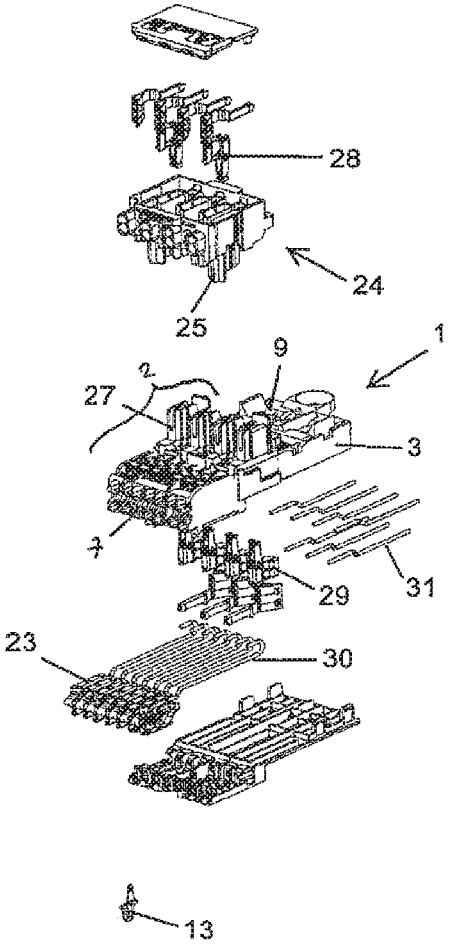
FIG. 9: exploded view of the device according to the invention as shown in FIG. 7.
Figure 10:
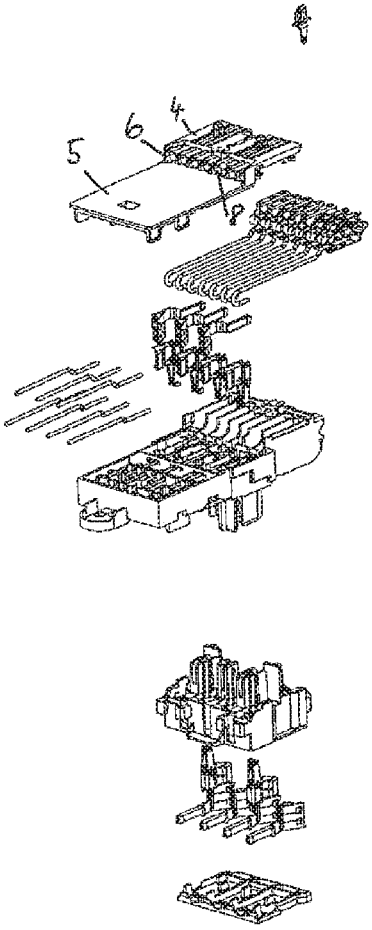
FIG. 10: further exploded view of the device according to the invention as shown in FIG. 9.

An exploded view of this embodiment is shown in FIG. 9 and FIG. 10. In the contacting points 27, punched parts 29 are provided, in the contacts 25 of the plug 24, punched parts 28 are similarly provided. It is advantageous if the punched parts 28 and 29 are each integrated in their components. Per se known punched parts can be used, even the same but contrary punched parts, on the one side, as fork contact and on the other side as transverse contact, so that they match one another. Such a combination between plug and coupling particularly suitable for relatively high current passages (16A) and relatively large cross-sections.

Connecting elements 30 and 31, which are conductive, connect the punched parts 23 to the respective contacting points 27 and 9. In the case of the connecting elements 30, a hook is present at one end, which is plugged into the punched parts.

Visible details in the drawings which have not been expressly described here are also the subject matter of the invention. Further embodiments of the device according to the invention which are not illustrated here should not be excluded from the invention.

REFERENCE NUMBERS

1. Device
2. Front housing part
3. Rear housing part
4. Lower side of 2
5. Lower side of 3
6. Step between 2 and 3
7. Contacting point
8. Contacting point
9. Contacting point
10. Plug
11. Contact
12. Terminal connection
13. Earth
14. Earth strip
15. Spring arm
16. Fastening element
17. Rail system
18. Sheet metal aperture
19. Plug
20. Contact
21. Terminal connection
22. Contacting point
23. Punched part
24. Plug
25. Contact
26. Connection point
27. Contacting point
28. Punched part
29. Punched part
30. Connection element
31. Connection element

The invention claimed is:

1. A device (1) for contacting electrical conductors and/or electrical plug connectors, with at least a front housing part (2) and a rear housing part (3), wherein the front housing part (2) and the rear housing part (3) are embodied as one unit, wherein at least one first electrical contact connection via contacting points (7) in the front housing part (2), and at least one additional electrical contact connection via contacting points (9) in the rear housing part (3) are provided, wherein a step (6) between the front housing part (2) and the rear housing part (3) is embodied on one side of the device, wherein contacting points (8) are provided for the electrical contact connection in a region of the step (6) and wherein the contacting points (8) extend from said region into the front housing part (2).

2. The device (1) according to claim 1, wherein the step (6) between the front housing part (2) and the rear housing part (3) is embodied on the lower side (4, 5) of the device (1).

3. The device (1) according to claim 1 wherein a clearance is provided at the lower side (5) of the rear housing part (3).

4. The device (1) according to claim 1, wherein the electrical contact connection of the contacting points (8) in the region of the step (6) is provided directly with the first electrical contact connection of the contacting points (7) in the front housing part (2).

5. The device (1) according to claim 1, wherein the electrical contact connection to further electrical or electronic devices is provided at the contacting points (8) in the region of the step (6) for rigid or flexible electrical conductors or plug connectors.

6. The device (1) according to claim 1, wherein at least one electrical contact connection via contacting points (9) is provided on the rear housing part (3) for the electrical contact connection with further electrical or electronic devices, and that at least one electrical contact connection via contacting points (27) is provided on the rear housing part (3) for the electrical supply, especially mains supply, wherein the electrical contact connection takes place especially via punched parts (28, 29).

7. The device according to claim 6, wherein the electrical contact connections are embodied as plug connections via contacting points (9, 27) on the rear housing part (3).

8. The device (1) according to claim 1, wherein an earth contact (13) is present in the device (1), and at least one contacting point (7) for the earth contact (13) is provided.

9. The device (1) according to claim 8, wherein the earth contact is embodied on the device (1) as an earth strip (14) and/or that, in the pre-stressed condition, the earth contact (13, 14) is active with a further component.

10. A lamp or electrical device with a device (1) according to claim 1.

* * * * *